US012330751B2

(12) United States Patent
Webster

(10) Patent No.: US 12,330,751 B2
(45) Date of Patent: Jun. 17, 2025

(54) TENSION FOUNDATION FOR HOLDING A BUOYANT OBJECT

(71) Applicant: Tornado Anchors, LLC, La Grange, IL (US)

(72) Inventor: Keith Webster, La Grange, IL (US)

(73) Assignee: Tornado Anchors, LLC, La Grange, IL (US)

( * ) Notice: Subject to any disclaimer, the term of this patent is extended or adjusted under 35 U.S.C. 154(b) by 0 days.

(21) Appl. No.: 18/753,442

(22) Filed: Jun. 25, 2024

(65) Prior Publication Data

US 2024/0343349 A1 Oct. 17, 2024

Related U.S. Application Data

(63) Continuation of application No. 17/141,413, filed on Jan. 5, 2021, now abandoned.

(60) Provisional application No. 62/979,593, filed on Feb. 21, 2020.

(51) Int. Cl.

| | |
|---|---|
| ***B63B 21/29*** | (2006.01) |
| ***B63B 21/26*** | (2006.01) |
| ***B63B 21/38*** | (2006.01) |

(52) U.S. Cl.

CPC ..... *B63B 21/29* (2013.01); *B63B 21/26* (2013.01); *B63B 21/38* (2013.01); *B63B 2021/262* (2013.01)

(58) Field of Classification Search

CPC ..... B63B 21/24; B63B 21/243; B63B 21/26; B63B 21/29; B63B 21/30; B63B 21/34; B63B 21/38; B63B 21/44; B63B 2021/262

USPC ..... 114/294, 295, 300, 311, 301, 303, 304

See application file for complete search history.

(56) References Cited

U.S. PATENT DOCUMENTS 4,403,564 A * 9/1983 Garvin ..... B63B 21/46 114/299

OTHER PUBLICATIONS

Internet post Apr. 12, 2011, gjbugtosser incorporated JohnnyCash (Year: 2011).*
Ironmaster UK (Year: 2018).*
Eleiko Anti-roll discs (Year: 2017).*
Gjbugtosser (Year: 2013).*
TuffStuff Weight Pack (Year: 2017).*

* cited by examiner

*Primary Examiner* — Sunil Singh
(74) *Attorney, Agent, or Firm* — Nyman IP LLC; Scott Nyman

(57) ABSTRACT

A tension foundation is provided for holding a buoyant object in flowing water via a tether. The tension foundation may include a spine component, rotation members rotatable about the spine component, slats, and additional features. The rotation members can include multiple types with distinct dimension ratios, which may be arranged in an alternating pattern. During operation, the tension foundation advantageously provides increased contacting edges to grip an uneven surface, such as a rocky lakebed or river bottom.

15 Claims, 7 Drawing Sheets

TENSION FOUNDATION FOR HOLDING A BUOYANT OBJECT

CROSS-REFERENCE TO RELATED APPLICATION

This application is a continuation of and claims priority to U.S. nonprovisional utility patent application Ser. No. 17/141,413 filed Jan. 5, 2021 and since abandoned on Jul. 10, 2024, which further claims the priority from U.S. provisional patent application Ser. No. 62/979,593 filed Feb. 21, 2020. The foregoing applications are incorporated in their entirety herein by reference.

FIELD OF THE INVENTION

The present disclosure relates to a tension foundation. More particularly, the disclosure relates to holding a buoyant object in flowing water via a tether connected between the buoyant object and the tension foundation.

BACKGROUND

Conventional anchors of the sort that have been used on watercraft for many years are designed as pyramids, spikes, or chains, and are most commonly constructed of lead. Conventional anchors function by rolling and sliding along the river bottom or other terrain underneath the static and/or flowing water, until grabbing onto the terrain. For bodies with faster water flow, it becomes more difficult for the anchor to grab onto the terrain and stop the watercraft. Conventional anchors include a single edge that will come into contact with the terrain. This design limits operability because the static, fixed, nature of the design renders such anchors incapable of adapting to different types of terrain and varying conditions. Conventional anchors are, therefore, limited with regard to the locations at which, and conditions under which, they are able to grab onto and hold onto the terrain.

Therefore, a need exists to solve the deficiencies present in the prior art. What is needed is a tension foundation with improved operational utility when used in rivers and other bodies of flowing water. What is needed is a tension foundation with improved operational utility when used in static and/or moving bodies of water. What is needed is a tension foundation with adaptable members to secure a buoyant object when deployed. What is needed is a tension foundation configured to improve holding capacity when used in moving-water environments, such as a river. What is needed is a method for holding a buoyant object in a body of flowing water, such as a river.

SUMMARY

An aspect of the disclosure advantageously provides a tension foundation with improved operational utility when used in flowing water. An aspect of the disclosure advantageously provides a tension foundation with improved operational utility when used in static and/or moving bodies of water. An aspect of the disclosure advantageously provides a tension foundation with adaptable members to secure a buoyant object when deployed. An aspect of the disclosure advantageously provides a tension foundation configured to improve holding capacity when used in moving-water environments, such as a river. An aspect of the disclosure advantageously provides a method for holding a watercraft or other buoyant object stationary in a body of flowing water, such as a river.

A tension foundation enabled by this disclosure may advantageously stop buoyant objects, such as watercraft, more effectively and hold buoyant objects in place more effectively with respect to a body of water, than conventional anchors. A tension foundation enabled by this disclosure may be operated in various types of bodies of water, for example, in static water such as a lake and/or flowing water such as a river, without limitation. The following disclosure describes a tension foundation including improvements in design, material used, and performance, relative to the prior art. A tension foundation enabled by this disclosure may include rotation members made of galvanized steel or other very durable material, which contributes to the enhanced durability of the anchors of the present invention relative to conventional anchors made of lead. Further, conventional anchors operate by dragging to a stop; the series of independently rotating rotation members of the present invention actively dig into the riverbed or other terrain underneath the body of water quicker than conventional anchors and exhibit greater holding capacity (i.e., ability to hold onto the terrain to which the anchor attaches) than conventional anchors. These and other attributes of a tension foundation enabled by this disclosure provide watercraft operators with greater flexibility with regard to the range of locations at which, and conditions under which, the watercraft may be stopped and secured.

According to an embodiment of this disclosure, a tension foundation for holding a buoyant object in flowing water via a tether is provided. The tension foundation may comprise a spine component selectively attached to the tether and rotation members bounded by a perimeter of rotation member edges. The rotation members may comprise a rotation member opening. The spine component may be located within the rotation member opening. The rotation members may be oriented substantially perpendicular to the spine component. Each of the rotation members may operatively rotate about the spine component via the rotation member opening substantially independent of each other, such that at least one of the rotation member edges may interface with a portion of a riverbed to distribute a tension force between the riverbed and the buoyant object.

In another aspect, the rotation member opening of the rotation members may be located substantially in a center of each rotation member.

In another aspect, the spine component may extend beyond the rotation members. The spine component may comprise a mounting component on a spine component mounting end to receive the tension force. The spine component may further comprise a locking mechanism on a spine component distal end.

In another aspect, the rotation members and the spine component may be comprised of a durable material.

In another aspect, the rotation members may comprise first rotation members and second rotation members that are different than the first rotation members.

In another aspect, the first rotation members may be defined by a first dimension ratio of first rotation member edges. The second rotation members may be defined by a second dimension ratio of second rotation member edges that is different than the first dimension ratio. The dimension ratio of the first rotation member edges may be different from the dimension ratio of the second rotation member edges.

In another aspect, the first rotation members and the second rotation members may be arranged in an alternating pattern.

In another aspect, slats may be included between the first rotation members and the second rotation members.

According to an embodiment of this disclosure, a tension foundation for holding a watercraft in flowing water via a tether may be provided. The tension foundation may comprise a spine component selectively attached to the tether and rotation members bounded by a perimeter of rotation member edges. The rotation members may comprise a rotation member opening. The rotation members may comprise first rotation members and second rotation members. The spine component may be located within the rotation member opening. The rotation members may be oriented substantially perpendicular to the spine component. Each of the rotation members may operatively rotate about the spine component via the rotation member opening substantially independent of each other, such that at least one of the rotation member edges may interface with a portion of a riverbed to distribute a tension force between the riverbed and the watercraft. The spine component may extend beyond the rotation members. The spine component may comprise a mounting component on a spine component mounting end to receive the tension force. The spine component may further comprise a locking mechanism on a spine component distal end.

In another aspect, the rotation member opening of the rotation members may be located substantially in a center of each rotation member.

In another aspect, the rotation members and the spine component may be comprised of a durable material.

In another aspect, the first rotation members may be defined by a first dimension ratio of first rotation member edges. The second rotation members may be defined by a second dimension ratio of second rotation member edges. The first dimension ratio of the first rotation member edges may be different from the second dimension ratio of the second rotation member edges.

In another aspect, the first rotation members and the second rotation members may be arranged in an alternating pattern.

In another aspect, slats may be included between the first rotation members and the second rotation members.

In another aspect, the spine component may comprise threading near the distal spine component end. A locking nut may be removably installed to the threading to substantially secure the rotating members to the spine component.

According to an embodiment of this disclosure, a tension foundation for holding a buoyant object in flowing water via a tether is provided. The tension foundation may comprise rotation members constructed of a durable material, wherein each of the rotation members may comprise a rotation member opening, and a spine component passed through the rotation member opening of the rotation members, wherein the spine component may be selectively attached to the tether. The rotation members may further comprise first rotation members, wherein the first rotation members may be defined by a first dimension ratio of first rotation member edges, and second rotation members, wherein the second rotation members may be defined by a second dimension ratio of second rotation member edges. The rotation members may be oriented substantially perpendicular to the spine component. Each of the rotation members may operatively rotate about the spine component via the rotation member opening substantially independent of each other, such that at least one of the rotation member edges may interface with a portion of a riverbed to distribute a tension force between the riverbed and the buoyant object.

In another aspect, the rotation member opening of the rotation members may be located substantially in a center of each rotation member.

In another aspect, the first dimension ratio of the first rotation member edges may be different from the second dimension ratio of the second rotation member edges.

In another aspect, the first rotation members and the second rotation members may be arranged in an alternating pattern.

In another aspect, slats may be included between the first rotation members and the second rotation members.

Terms and expressions used throughout this disclosure are to be interpreted broadly. Terms are intended to be understood respective to the definitions provided by this specification. Technical dictionaries and common meanings understood within the applicable art are intended to supplement these definitions. In instances where no suitable definition can be determined from the specification or technical dictionaries, such terms should be understood according to their plain and common meaning. However, any definitions provided by the specification will govern above all other sources.

Various objects, features, aspects, and advantages described by this disclosure will become more apparent from the following detailed description, along with the accompanying drawings in which like numerals represent like components.

DETAILED DESCRIPTION

Figure 1:
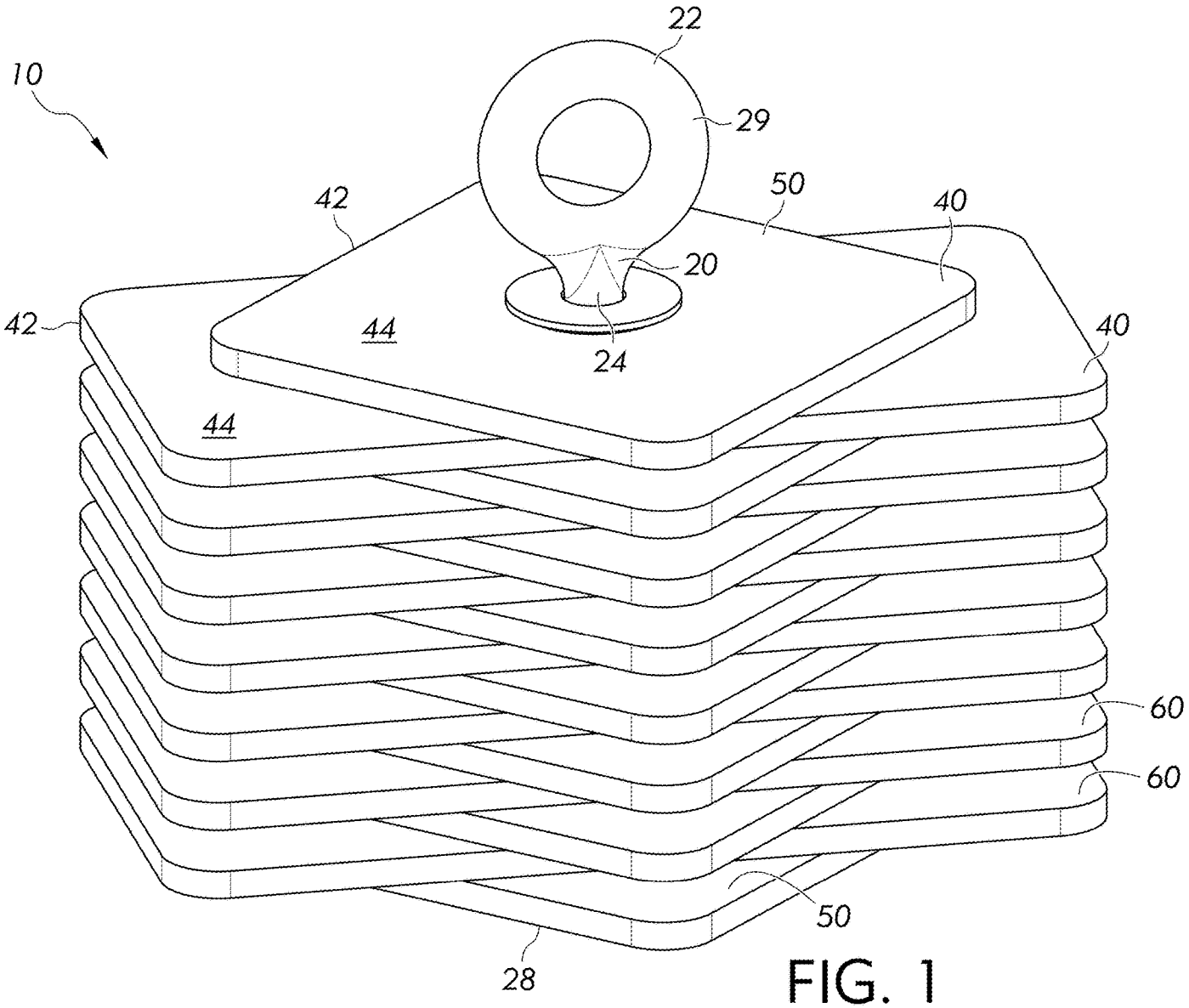
FIG. 1 is a perspective view of an anchor device, according to an embodiment of this disclosure.
Figure 2:
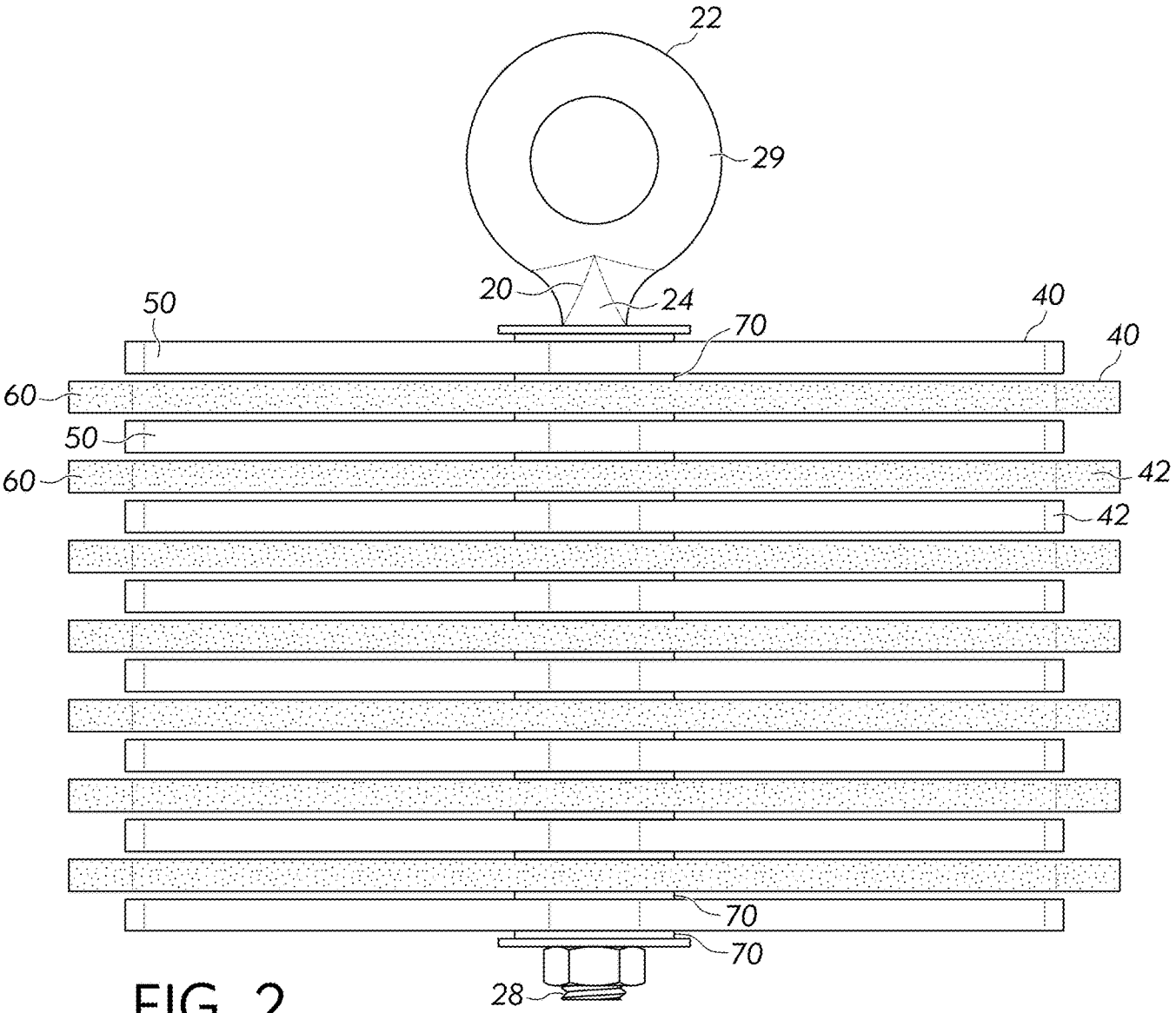
FIG. 2 is a side elevation view of an anchor device, according to an embodiment of this disclosure.

The following disclosure is provided to describe various embodiments of an anchor device. Skilled artisans will appreciate additional embodiments and uses of the present invention that extend beyond the examples of this disclosure. Terms included by any claim that may be presented with this disclosure are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

For the purpose of clearly describing the components and features discussed throughout this disclosure, some frequently used terms will now be defined, without limitation. The term anchor, as it is used throughout this disclosure, is defined as something that serves to hold an object firmly. The term spine component, as it is used throughout this disclosure, is defined as a elongated member to which one or more slats may be installed, with the spine being alignable about a central axis. The term flowing water, as it is used throughout this disclosure, is defined as water moving in an approximately consistent direction, such as within a stream or a river. The term river, as it is used throughout this disclosure, is defined as a natural stream of water flowing in a definite course or channel or series of diverging and/or converging channels. The term static water, as it is used throughout this disclosure, is defined as a body of water with no or minimal movement such as a lake, pond, sea, reservoir, or other similar body of water that would be appreciated by those of skill in the art. The term body of water, as it is used throughout this disclosure, is defined to include a collection of flowing and/or static water. The term terrain, as it is used throughout this disclosure, is defined as a surface upon which objects may be located, such as a ground surface, lake bottom, sea floor, riverbed, and/or other similar surfaces, without limitation.

Various aspects of the present disclosure will now be described in detail, without limitation. In the following disclosure, an anchor device will be discussed. Those of skill in the art will appreciate alternative labeling of the anchor device as an anchor, river anchor, tornado anchor, watercraft securing device, the invention, or other similar names. Similarly, those of skill in the art will appreciate alternative labeling of the anchor device as a watercraft securing technique, river anchoring method, operation for securing a watercraft in flowing water, method, operation, the invention, or other similar names. Skilled readers should not view the inclusion of any alternative labels as limiting in any way.

Anchor devices described throughout and enabled by this disclosure are designed to better align themselves with the different contours encountered along the bottom of streams of flowing water and/or floor of static water. An anchor device will be discussed throughout this disclosure in various embodiments. In at least one embodiment, the anchor device may include an increased number of edges compared to traditional pyramid-type anchors (i.e., the edges of the rotation members) than conventional anchors so that there is more surface-to-edge contact. This greater surface-to-edge contact advantageously increases the surface area that may make contact with a terrain, and thus may provide for more opportunity for the anchor to grab onto the terrain. In order to accomplish this goal, an anchor device may be designed as a series of rotation members aligned about a spine. These rotation members may be comprised of a series of stacked plates or blades. These rotation members may be stacked along a spine component that includes securing features, such as a central eye bolt and a lock nut. These rotation members may be separated by uniform and/or non-uniform slats. Those of skill in the art will appreciate that the labeling of slats as uniform or non-uniform slats is intended to help distinguish the types of slats having differing dimensions and is not intended to limit the invention to only slats having specific dimensions as shown in the figures.

The design of an anchor device enabled by this disclosure may create a ribbed and/or contoured surface, advantageously providing a greater number of exposed edges compared to conventional anchors. The rotation members may be stacked, which may also substantially freely rotate independently around the spine component to conform to changing conditions. Those of skill in the art will appreciate that the presence of natural friction or physical forces present where two masses meet is not intended to limit the present disclosure and is intended to be considered in the context of being able to freely rotate.

This rotation may advantageously provide an anchor that is able to react to its environment and create an increased amount of drag and increase the portion of drag that is substantially uninterrupted. This improved drag may allow for stopping the watercraft faster or better holding the watercraft to a desired position than traditional anchors. In one example provided in the interest of clarity, as the rotation members rotate, the overall shape of the anchor may change and adapt to allow more linear-edge surface area of the rotation members to grip onto, and dig into, the anchoring surface or other terrain. This enhanced surface-edge contact between the rotation members and the terrain relative to conventional anchors allows for greater flexibility with regard to when the watercraft may be stopped and/or held at a desired location. This greater flexibility is the product of the wider range of locations where, and conditions under which, the anchor is able to effectively grab onto and hold onto the anchoring surface or other terrain. The improved design of an anchor enabled by this disclosure may further allow for more effective use of the weight of the anchor.

Referring now to FIGS. 1-9, an illustrative anchor device 10 will now be discussed in more detail. The anchor device 10 may include a spine component 20, rotation members 40, slats 70, a tether mounting component 80, and/or additional components that will be discussed in greater detail below. The anchor device 10 may operate one or more of these components interactively with other components for securing a watercraft in a body of water via an improved grip by the anchor device on an anchor surface, for example, a river bed or lake bed.

The spine component 20 will now be discussed in greater detail. The spine component 20 may serve as an axis around which the rotation members 40 may rotate. The spine component 20 may include an elongated spine component member 24 extending from a mounting spine component end 22 to a distal spine component end 28. In one embodiment, the spine component 20 may comprise an eye bolt 29 at the mounting spine component end 22 of the spine component 20. The elongated spine component member 24 of the spine component 20 may be constructed such that it may pass through openings or apertures provided by other components of a device enabled by this disclosure, for example a rotation member opening 46 provided by a rotation member 40. The spine component 20 may be secured at the distal spine component end 28 via attachment hardware, for example, a lock nut.

In one embodiment, the eye bolt 29 may be located at the mounting spine component end 22 of the spine component 20, for example, being designed as a closed eye loop. A tether 82 and/or tether mounting component 80 may be operatively attached to the spine component 20 at the mounting spine component end 22, for example, via the eyebolt 29, if included. Skilled artisans will appreciate additional embodiments of the mounting spine component end 22 of the spine component 20 may include configurations alternative to an eye loop, for example, an at least partially unclosed loop, a hook, a locking loop, a carabiner attachment, or another interface that would be apparent to a person of skill in the art after having the benefit of this disclosure, without limitation.

The elongated spine component member 24 of the spine component 20 may extend downwardly from the mounting spine component end 22 to a distal spine component end 28. In one embodiment, the distal spine component end 28 of the spine component 20 may be threaded, for example, to receive a locking nut, without limitation.

The spine component 20 may be made of a durable material. For example, the spine component 20 may be made of steel, as would be appreciated by skilled artisans familiar with industry standards. In one embodiment, the spine component 20 may preferably be constructed of galvanized steel. In additional embodiments, the spine component 20 may be constructed of other durable materials such as stainless steel, composites, and/or other materials that would be appreciated by those of skill in the art. Use of a thick steel may require use of a correspondingly larger tether mounting component 80, tether 82, locking connector, carabiner, or other interface components to attach an anchor device 10 enabled by this disclosure to a watercraft.

The spine component 20 may be lift weighted to accommodate substantial force. In one embodiment, the spine component 20 may accommodate a load of at least 2200 lbs. of force, without limitation. Skilled artisans will appreciate additional embodiments with different load accommodations after having the benefit of this disclosure.

The rotation members 40 will now be discussed in greater detail. The figures highlight examples of the rotation members 40. An invention enabled by the present disclosure may include virtually any number of rotation members 40. Additionally, an invention enabled by this disclosure may include rotation members in various shapes, sizes, thicknesses, flatness, contours, having various edges, and/or otherwise configured, as will be appreciated by a person of skill in the art after having the benefit of this disclosure. The skilled artisan will appreciate that typically the more rotation members 40 that are included, the heavier the anchor may be.

In one embodiment, the rotation members 40 may be configured as plates and/or blades, without limitation. The rotation members 40 may be constructed of virtually any number of durable materials, for example, galvanized steel. In other embodiments, an anchor device 10 enabled by this disclosure may include rotation members 40 constructed of, without limitation, steel, stainless steel, brass, lead, composite materials, molded materials, and/or another material that would be appreciated by those of skill in the art after having the benefit of this disclosure.

In another embodiment, the rotation members 40 may optionally be powder-coated to further enhance durability of an anchor device onto which they are installed. In one embodiment, the powder-coating contemplated by this disclosure may be formulated as to not produce any undesirable compounds during application or use that are harmful to the environment.

The rotation members 40 may be configured in various shapes, which may be determined according to an intended application and customer request. For example, the rotation members 40 may be constructed in substantially rectangular shapes of varying lengths and widths. In this example, the rotation members 40 may include rotation member edges 42 that are substantially linear and rotation member faces 44 that are substantially flat. In another embodiment, at least one of the rotation member edges may be arcuate, curved, beveled, angled, textured, saw-toothed, and/or otherwise configured, without limitation. Additionally, in various embodiments, the at least some of the rotation members may be non-rectangular, for example being provided as a triangle, circle, oval, pentagon, hexagon, heptagon, octagon, animal shape, theme shaped, provided as an outline resembling a consumer-defined object, or otherwise. In one embodiment, the shape of at least some of the rotation members may be provided to resemble a sports team logo, licensed image, custom image, and/or other shape as would be appreciated by those of skill in the art.

In one embodiment, the rotation members 40 may include at first rotation member 50 and a second rotation member 60, which may collectively provide the rotation members 40. Those of skill in the art will appreciate that further additional rotation member configurations may be included by an anchor device enabled by this disclosure without limitation, and that the examples given throughout this disclosure having a first rotation member configuration and a second rotation member configuration are not intended to limit the disclosure to only those embodiments.

Figure 3:
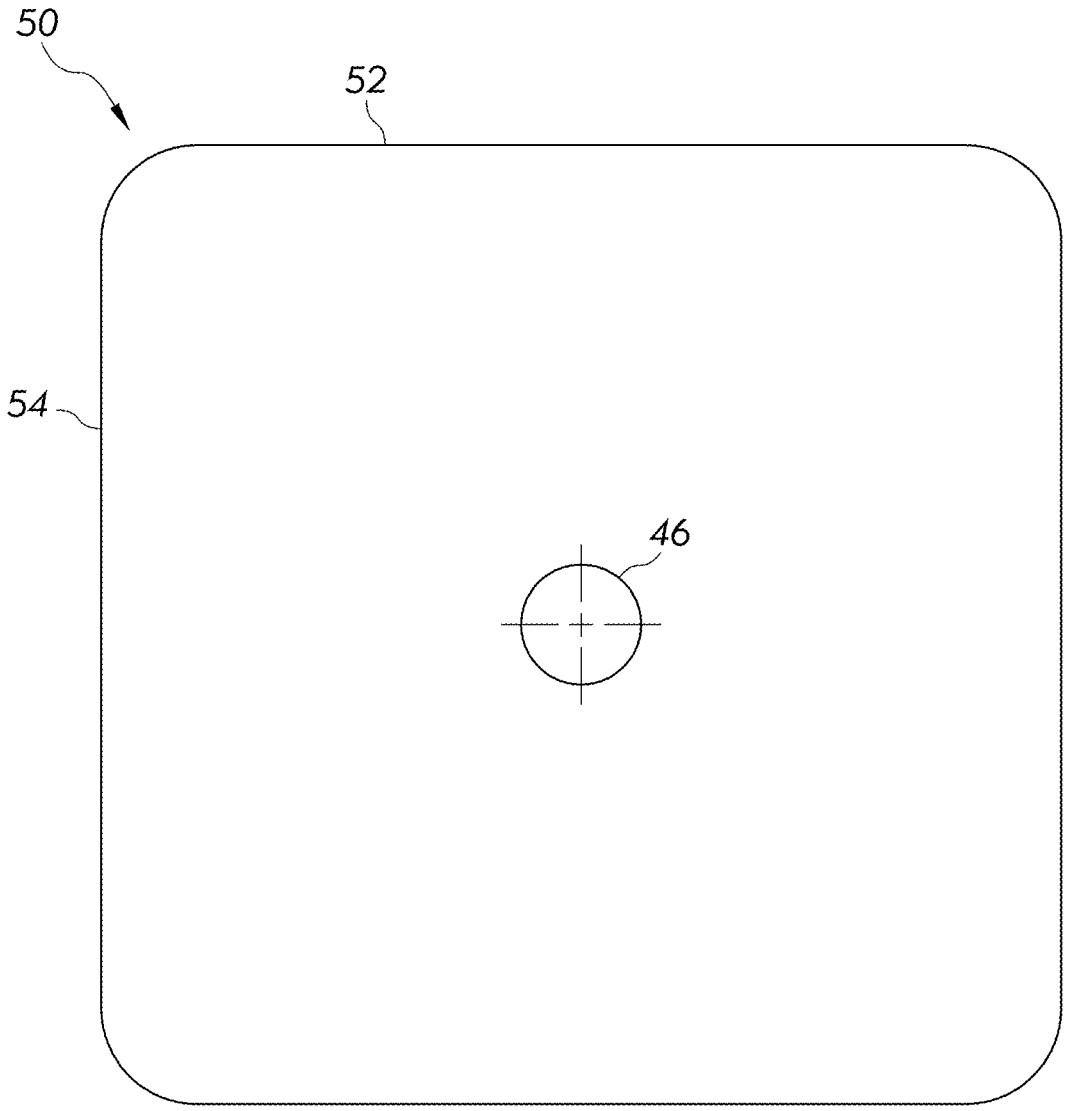
FIG. 3 is a top plan view of a first rotation member, according to an embodiment of this disclosure.
Figure 4:
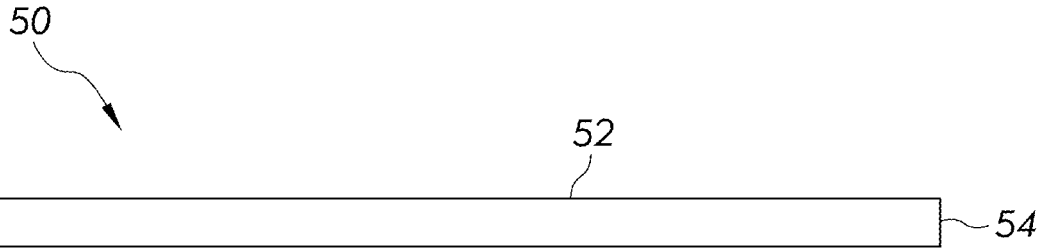
FIG. 4 is a side elevation view of a first rotation member, according to an embodiment of this disclosure.

For example, as shown in FIGS. 3-4, at least some of the rotation members 40 may be configured as a first rotation member 50. The first rotation member may include various edges, for example, at least one first rotation member length edge 52 and at least one first rotation member width edge 54. The first rotation member length edge 52 may be defined by a first rotation member length. Similarly, the first rotation member width edge 54 may be defined by a first rotation member width. In one embodiment, the first rotation member may include a first rotation member face, which may be bound between the first rotation member edges. The first rotation member face may have a first rotation member surface area, which may be defined by the rotation member edges by which it is bound.

In one example, provided without limitation, the first rotation member length edge may include dimensions between approximately 1.0 to 25.0 inches. However, those of skill in the art will appreciate that the first rotation member length edge may be about 1, 2, 3, 4, 5, 6, 7, 8, 9, 10, 11, 12, 13, 14, 15, 16, 17, 18, 19, 20, 21, 22, 23, 24, 25, 26, and/or another value in inches, without limitation. In one example, provided without limitation, the first rotation member width edge may include dimensions between approximately 1.0 to 20.0 inches. However, those of skill in the art will appreciate that the first rotation member width edge may be about 1, 2, 3, 4, 5, 6, 7, 8, 9, 10, 11, 12, 13, 14, 15, 16, 17, 18, 19, 20, 21, 22, 23, 24, 25, 26, and/or another value in inches, without limitation.

Figure 5:
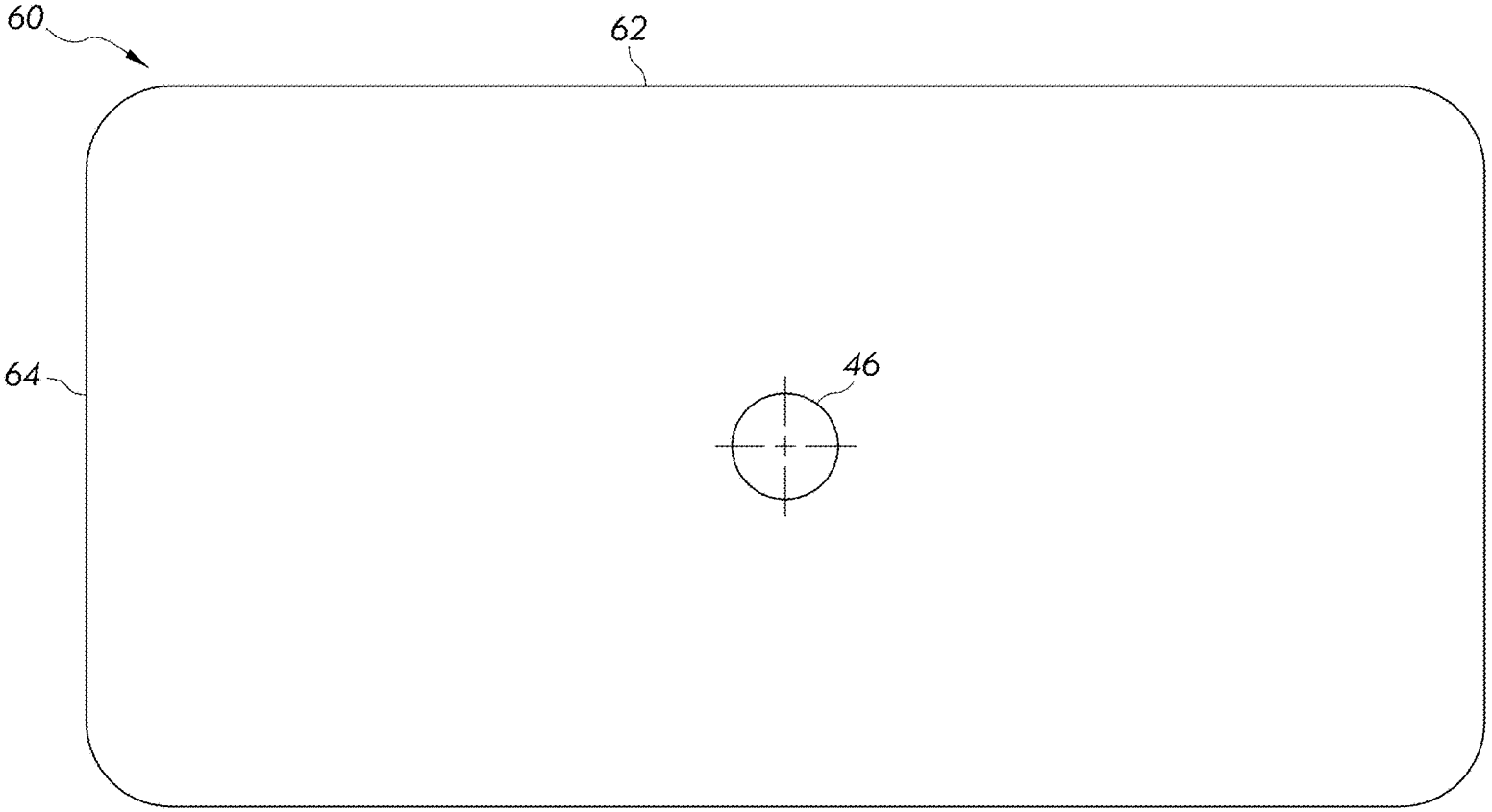
FIG. 5 is a top plan view of a second rotation member, according to an embodiment of this disclosure.
Figure 6:
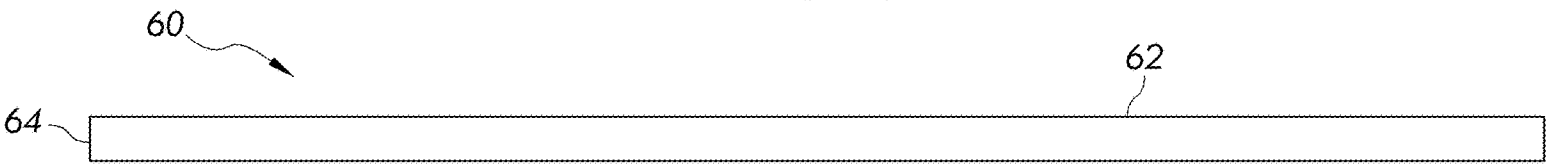
FIG. 6 is a side elevation view of a second rotation member, according to an embodiment of this disclosure.
Figure 7:
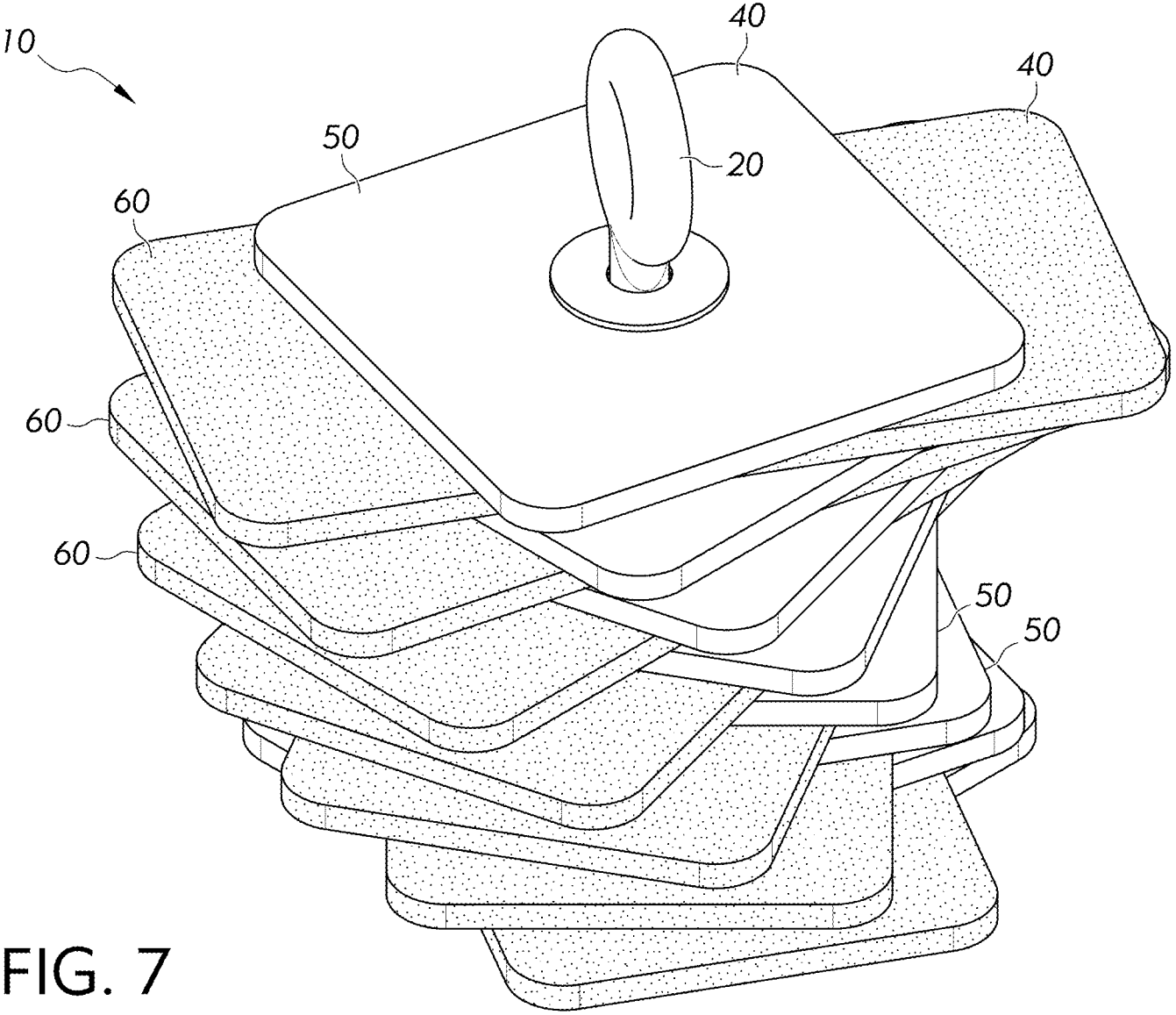
FIG. 7 is a perspective view of an anchor device with its rotation members rotated about the spine component, according to an embodiment of this disclosure.
Figure 8:
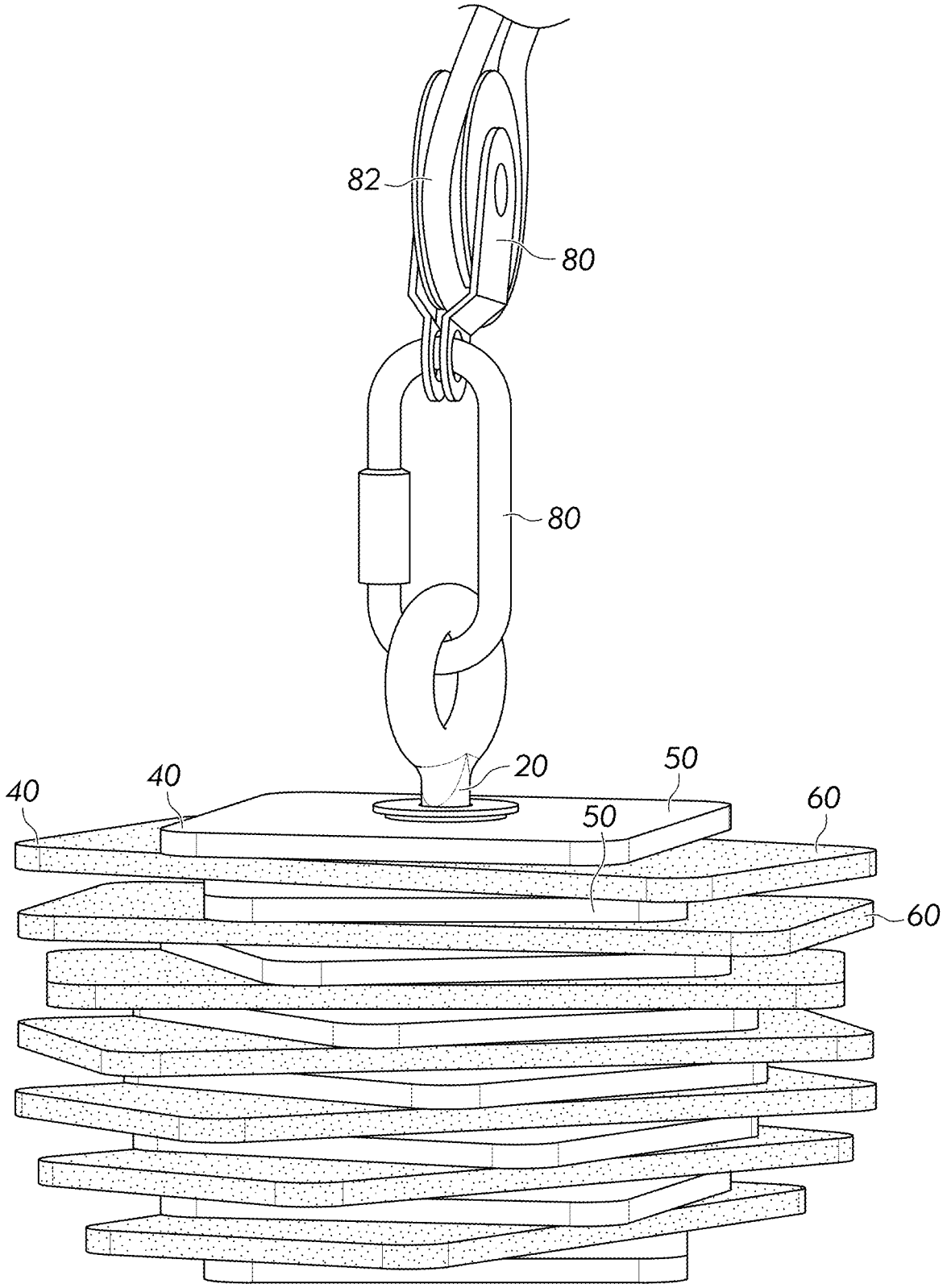
FIG. 8 is a side elevation view of an anchor device with its rotation members rotated about a spine component and showing a tether component, according to an embodiment of this disclosure.
Figure 9:
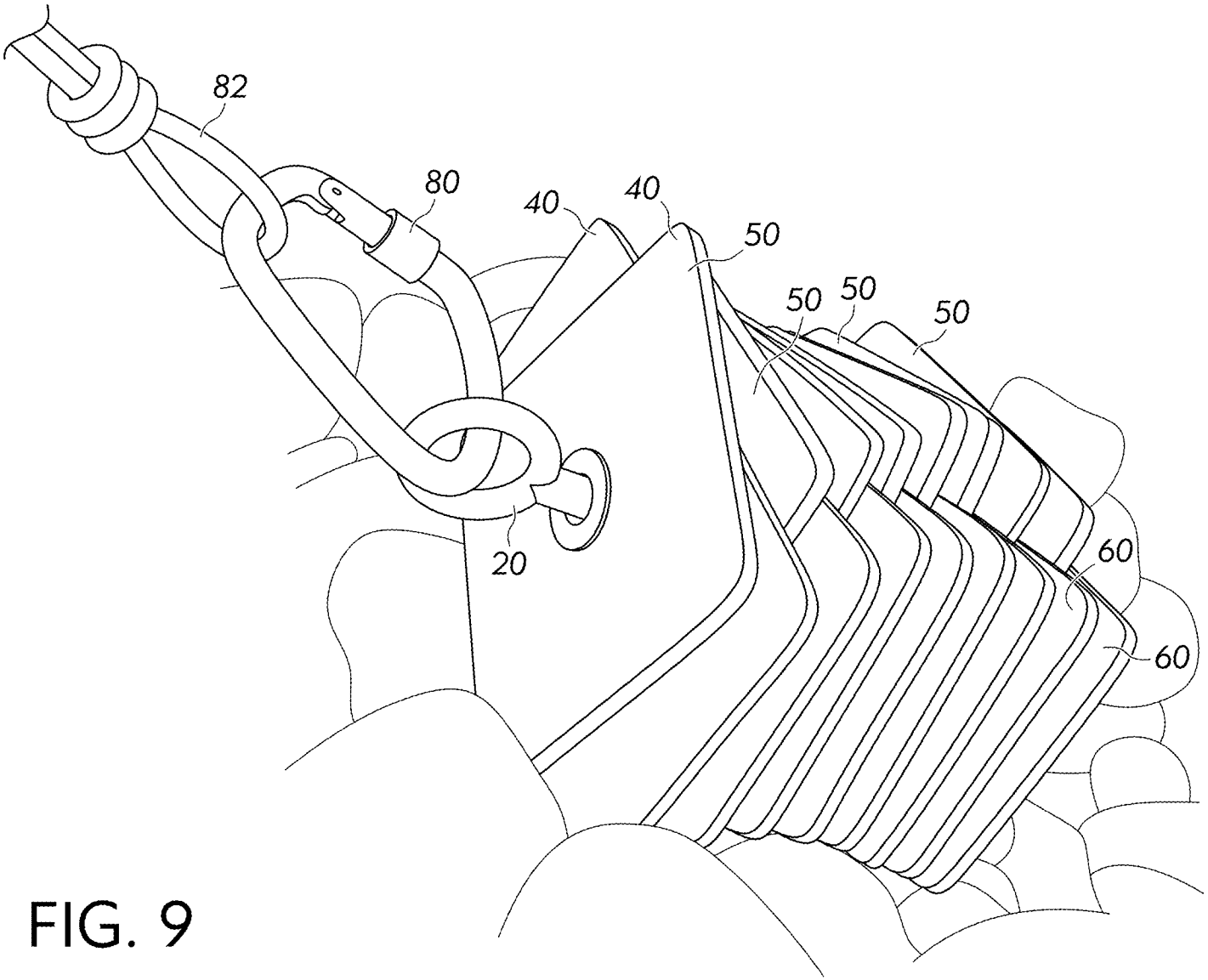
FIG. 9 is a perspective view of an anchor device deployed in a body of water provided as a river, according to an embodiment of this disclosure.

In another example, as shown in FIGS. 5-6, at least some of the rotation members 40 may be configured as a second rotation member 60. The second rotation member may include various edges, for example, at least one second rotation member length edge 62 and at least one second rotation member width edge 64. The second rotation member length edge 62 may be defined by a second rotation member length. Similarly, the second rotation member width edge 64 may be defined by a second rotation member width. In one embodiment, the second rotation member may include a second rotation member face, which may be bound between the second rotation member edges. The second rotation member face may have second rotation member surface area, which may be defined by the rotation member edges by which it is bound.

In one example, provided without limitation, the second rotation member length edge may include dimensions between approximately 1.0 to 25.0 inches. However, those of skill in the art will appreciate that the second rotation member length edge may be about 1, 2, 3, 4, 5, 6, 7, 8, 9, 10, 11, 12, 13, 14, 15, 16, 17, 18, 19, 20, 21, 22, 23, 24, 25, 26, and/or another value in inches, without limitation. In one example, provided without limitation, the second rotation member width edge may include dimensions between approximately 1.0 to 20.0 inches. However, those of skill in the art will appreciate that the second rotation member width edge may be about 1, 2, 3, 4, 5, 6, 7, 8, 9, 10, 11, 12, 13, 14, 15, 16, 17, 18, 19, 20, 21, 22, 23, 24, 25, 26, and/or another value in inches, without limitation.

The rotation members 40 may each include a rotation member opening 46. The rotation member opening 46 may be configured so that the spine component 20 can substantially freely pass through the rotation members 40. The rotation member opening 46 may pass substantially through the material that provides the rotation members 40. In one embodiment, the rotation member opening 46 may be located approximately in the center of the rotation member face 44 provided by the rotation member 40. In an alternative embodiment, the rotation member opening 46 may be offset from the center location of the corresponding rotation member face 44.

In one embodiment, provided without limitation, a diameter of the rotation member opening 46 may be approximately 0.5 to 1.0 inches. However, those of skill in the art will appreciate that rotation member opening may be about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.2, 3.4, 3.6, 3.8, 4.0, 4.5, 5, 5.5, 6, 7, 8, and/or another value in inches, without limitation. In at least one embodiment, the rotation member opening 46 may be provided having a diameter to correspond with a spine component 20 that may pass through the rotation members 40, which may permit ease of rotation without having an excessive gap.

Slats will now be discussed in greater detail. An anchor device 10 enabled by this disclosure may include slats 70 as a buffer material, interface, or other construction to be positioned between the rotation members 40 when installed to the spine component 20. In one embodiment, the slats 70 may be provided as a washer, such as a steel washer, nylon washer, plastic washer, synthetic washer, and/or other type of washer, without limitation. The slat 70 may be incorporated and/or installed between rotation members 40.

In one embodiment, the slats 70 may include uniform slats and non-uniform slats. In various embodiments, the slats 70 may be made of a material that with reduced friction compared to the rotation members 40. Example materials from which the slats 70 may be constructed include nylon, durable plastics, metal, composites, Teflon® and/or other materials, without limitation. The slats 70 of the present disclosure may be approximately uniform in shape relative to one another, may be non-uniform in shape relative to one another, and/or may include a combination of uniform and non-uniform members.

A locking feature, such as a lock or locking nut, nut may be operatively attached or installed to the distal spine component end 28 of the spine component 20, without limitation. The locking feature may fasten the rotation members 40 and slats 70 to the spine component 20. The fastening of the locking feature, for example lock nut, to the distal spine component end 28 of the spine component 20 may considerably reduce the likelihood of the various components of an anchor device enabled by this disclosure from loosening during use. In one embodiment, a slat 70 may be provided at the distal spine component end 28 of the spine component 20, such as between a locking feature and the terminal rotation member, to provide the anchor with additional structural strength.

The tether mounting component 80 will now be discussed in greater detail. The figures highlight examples of the tether mounting component 80. A tether may be provided as an interface member to which other components may be attached. In one example, the tether mounting component 80 may be removably attached to the mounting spine component end 22 of the spine component 20. The tether mounting component 80 may additionally be removably attached to a tether 82, which may interface with a watercraft, without limitation. In one example, the tether mounting component 80 may include features to facilitate attaching an anchor device enabled by this disclosure to a tether 82, and thus to a watercraft to which the tether may be attached. The tether mounting component 80 may include a carabiner, chain link, pulley, and/or other interface feature that may be operatively attached to a watercraft or other object that is desired to be held in place by an anchor device enabled by this disclosure.

An anchor device enabled by this disclosure may be provided having a wide range of weights. In one embodiment, an effective weight for the anchor may typically be impacted by the nature and size of the watercraft. For example, for drift boats, skiffs, and rafts that are 14 feet in length and under, a preferred anchor configuration may include components weighing about 25 lbs. Where the drift boat, skiff, or raft is 15 to 18 feet in length, a preferred anchor configuration may include components weighing about 34 lbs. Where the anchor will be used in connection with a drift boat or sled in rougher water and with heavier rigs, a preferred anchor configuration may include components weighing about 45 lbs. Those of skill in the art will appreciate additional weights and configurations that could correspond with various watercraft types, sizes, weights, and shapes after having the benefit if this disclosure.

In operation, a method may be provided for securing a watercraft to an anchoring surface or other terrain provided by a body of water, such as a river bottom or lake floor via an improved anchor. Those of skill in the art will appreciate that the following methods are provided to illustrate an embodiment of the disclosure, and should not be viewed as limiting the disclosure to only those methods or aspects. Skilled artisans will appreciate additional methods within the scope and spirit of the disclosure for performing the operations provided by the examples below after having the benefit of this disclosure. Such additional methods are intended to be included by this disclosure.

According to an embodiment of this disclosure, an illustrative method for securing a watercraft to terrain such as a river bottom via an improved anchor assembly is described. The following example is not intended to limit the use of an anchor device 10 enabled by this disclosure to only applications in flowing water, as such an anchor device 10 may also be operated in virtually any body of water including static water such as lakes, ponds, reservoirs, and/or other bodies of water, without limitation.

The operation may begin by releasing the anchor device into a body of water, wherein the anchor device is operatively connected to a tether and the tether is operatively connected to a watercraft. The tether mounting component may be secured to the watercraft, as would be appreciated by skilled artisans. The method may further comprise allowing for the rotation members of an anchor device enabled by this disclosure to contact with the river bottom or other anchoring surface relating to a body of water.

The method may further comprise rotation of the rotation members according to the contour of the anchoring surface or other terrain and other conditions once an anchor device enabled by this disclosure has entered the water and descended to the bottom of the river or other body of water. The method may further comprise rotation of the rotation members in a manner that results in the rotation members grabbing onto, and thereafter holding onto and/or digging into, the anchoring surface or other terrain. The method may further comprise slowing and/or cessation of movement of the watercraft as a result of the securing of the watercraft to the river bottom or other terrain with respect to the body of water. The method may further comprise separating the rotation members using slats to decrease friction between the rotation members, thereby facilitating rotation of said rotation members.

While various aspects of the present invention have been described in the above disclosure, the description of this disclosure is intended to illustrate and not limit the scope of the invention. The invention is defined by the scope of the claims included with this disclosure and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding accompanying this disclosure.

What is claimed is:

1. A tension foundation for holding a buoyant object in flowing water via a tether, comprising:

a spine component selectively attached to the tether;

rotation members, wherein each of the rotation members are bounded by a perimeter of rotation member edges, and wherein the each of the rotation members comprise a rotation member opening;

wherein the spine component is located within the rotation member opening of the each of the rotation members;

wherein the rotation members comprise:

first rotation members that are defined by a first dimension ratio of first rotation member edges, and second rotation members that are defined by a second dimension ratio of second rotation member edges, the second dimension ratio being different than the first dimension ratio;

wherein the rotation members are oriented substantially perpendicular to the spine component;

wherein the first rotation members and the second rotation members are arranged in an alternating pattern with slats being included between each of the first rotation members and the second rotation members; and wherein the each of the rotation members operatively rotate about the spine component via the rotation member opening substantially independent of each other, such that at least one of the rotation member edges interfaces with a portion of a riverbed to distribute a tension force between the riverbed and the buoyant object via the tether.

2. The tension foundation of claim 1, wherein the rotation member opening of the each of the rotation members is located substantially in a center of the each of the rotation members.

3. The tension foundation of claim 1, wherein the spine component extends beyond the rotation members;

wherein the spine component extends from a spine component mounting end of the spine component to a spine component distal end of the spine component;

wherein the spine component comprises a mounting component at the spine component mounting end of the spine component to receive the tension force; and wherein the spine component further comprises a locking mechanism at the spine component distal end of the spine component.

4. The tension foundation of claim 1, wherein the rotation members and the spine component are comprised of a durable material.

5. A tension foundation for holding a watercraft in flowing water via a tether, comprising:

a spine component selectively attached to the tether;

rotation members, wherein each of the rotation members are flat and bounded by a perimeter of rotation member edges, and wherein each of the rotation members comprise a rotation member opening located substantially in a center of the each of the rotation members through which the spine component is located in perpendicular orientation to the each of the rotation members, the rotation members further comprising:

first rotation members, and second rotation members that are different than the first rotation members;

wherein the each of the rotation members operatively rotate about the spine component via the rotation member opening substantially independent of each other such that at least one of the rotation member edges of at least one of the rotation members interfaces with a portion of a riverbed to distribute a tension force between the portion of the riverbed and the watercraft via the tether;

wherein the spine component extends beyond the rotation members from a spine component distal end of the spine component to a spine component mounting end of the spine component that receives the tension force; and wherein slats are included between each of the first rotation members and the second rotation members.

6. The tension foundation of claim 5, wherein the spine component further comprises a locking mechanism at the spine component distal end of the spine component.

7. The tension foundation of claim 5, wherein the rotation members and the spine component are comprised of a durable material.

8. The tension foundation of claim 5, wherein the first rotation members are defined by a first dimension ratio of first rotation member edges;

wherein the second rotation members are defined by a second dimension ratio of second rotation member edges; and wherein the first dimension ratio of the first rotation member edges is different from the second dimension ratio of the second rotation member edges.

9. The tension foundation of claim 5, wherein the first rotation members and the second rotation members are arranged in an alternating pattern.

10. The tension foundation of claim 5, wherein the spine component comprises threading near the spine component distal end of the spine component; and wherein a locking nut is removably installed to the threading to substantially secure the rotating members to the spine component.

11. A tension foundation for holding a buoyant object in flowing water via a tether, comprising:

rotation members constructed of a durable material, wherein each of the rotation members comprise a rotation member opening, the rotation members comprising:

first rotation members defined by a first dimension ratio of first rotation member edges, and second rotation members defined by a second dimension ratio of second rotation member edges that is different than the first dimension ratio;

a spine component installed through the rotation member opening of the each of the rotation members in perpendicular orientation and selectively attached to the tether; and slats included between the first rotation members and the second rotation members; and wherein the each of the rotation members operatively rotate about the spine component via the rotation member opening of the each of the rotation members substantially independently of each other such that at least one of the rotation member edges interfaces with a portion of a riverbed to distribute a tension force between the portion of the riverbed and the buoyant object via the tether.

12. The tension foundation of claim 11, wherein the rotation member opening of the each of the rotation members is located substantially in a center of the each of the rotation members.

13. The tension foundation of claim 11, wherein the first dimension ratio of the first rotation member edges is different from the second dimension ratio of the second rotation member edges.

14. The tension foundation of claim 11, wherein the first rotation members and the second rotation members are arranged in an alternating pattern.

15. The tension foundation of claim 14, wherein the rotation members include at least five of the first rotation members and at least five of the second rotation members arranged in the alternating pattern to improve interfacing between the rotation member edges and the riverbed.

* * * * *